United States Patent [19]

Oakley, Jr. et al.

[11] Patent Number: 4,589,266

[45] Date of Patent: May 20, 1986

[54] CIRCULAR TERRY KNITTING MACHINE AND METHOD

[75] Inventors: C. Mitchell Oakley, Jr., Greensboro; William L. Chatman, Madison, both of N.C.

[73] Assignee: Stancil Textile Co., Inc., Greensboro, N.C.

[21] Appl. No.: 627,510

[22] Filed: Jul. 9, 1984

Related U.S. Application Data

[62] Division of Ser. No. 495,142, May 16, 1983, abandoned.

[51] Int. Cl.[4] ..... D04B 9/12; D04B 15/06

[52] U.S. Cl. ..... 66/12; 66/40; 66/93; 66/108 R; 66/133

[58] Field of Search ..... 66/40, 9 R, 12, 93, 66/108 R, 108 A, 133, 134

[56] References Cited

U.S. PATENT DOCUMENTS

| | | | |
|---|---|---|---|
| 2,102,369 | 12/1937 | Martel | 66/172 E |
| 2,220,803 | 11/1940 | Lesher | 66/172 E |
| 3,757,537 | 9/1973 | York | 66/9 R |
| 3,826,110 | 7/1974 | Holder | 66/9 R |
| 4,237,707 | 12/1980 | Safrit et al. | 66/172 E |
| 4,373,361 | 2/1983 | Thorneburg | 66/186 X |
| 4,397,161 | 8/1983 | Chesebro, Jr. et al. | 66/172 E X |

FOREIGN PATENT DOCUMENTS

| | | | |
|---|---|---|---|
| 664798 | 6/1964 | Italy | 66/133 |
| 17087 | of 1907 | United Kingdom | 66/40 |
| 124059 | 3/1959 | U.S.S.R. | 66/40 |
| 124999 | 4/1959 | U.S.S.R. | 66/9 R |
| 821570 | 4/1981 | U.S.S.R. | 66/93 |

*Primary Examiner*—Wm. Carter Reynolds

*Attorney, Agent, or Firm*—Charles R. Rhodes; Judith E. Garmon

[57] ABSTRACT

An athletic sock having a knit-in, cushioned shin area. Preferably the sock also includes a knit-in, cushioned sole and ribbed support rear leg area. The cushioned shin area of the athletic sock may be formed on a single feed, single drum knitting machine by needle manipulation rather than by sinker manipulation. A selectively operable, special cam operates in conjunction with a radially shiftable lifting cam, and with long and short butt needles. The special cam lifts the short butt needles to an intermediate level where they grasp the body yarn but not the terry yarn. The long butt needles meanwhile are initially lifted by the special cam to the same level as the short butt needles. However, the lifting cam, which is retracted to clear the short butt needles as they pass by, further elevates the long butt needles to the uppermost level where they grasp both the terry yarn and the body yarn as they are lowered by the center cam.

5 Claims, 11 Drawing Figures

CIRCULAR TERRY KNITTING MACHINE AND METHOD

This application is a divisional of Ser. No. 495,142, filed May 16, 1983, and now abandoned.

BACKGROUND AND SUMMARY OF THE INVENTION

This invention relates to athletic socks formed on circular knitting machines and more particularly to athletic socks having a knitted-in, cushioned shin area. The invention is also directed to the technique for forming such a type of athletic sock on circular, single drum, single feed knitting machines in which diametrically opposed cushioned areas are being formed in longitudinally spaced portions of the sock, i.e. the sole and the shin.

In certain athletic activities, such as soccer, the legs of the participants are subjected to abuse, and as a result bruises and scrapes may occur, particularly on the shin areas. Therefore, the present invention is concerned with providing an athletic sock In combination with the cushioned shin area, having a cushioned shin area; and in a preferred embodiment, the sole of the sock is also cushioned, and the rear half of the leg portion is formed with a ribbed, support construction.

At first impression, it may seem to the casual observor of ordinary skill in the art that such construction might be simple to accomplish. The fact of the matter is, to the knowledge of the inventors, there is no conventional knitting technique available for single drum, single feed circular knitting machines, whereby one may provide terry loops in one diametrical half of a tubular knit article in one longitudinal portion, then provide terry loops in the opposite diametrical half of the tubular garment in another linear portion. The conventional method for forming terry loops on a circular knitting machine is by the utilization and manipulation of terry sinkers which are controlled by cams in the sinker cap to radially position selected sinkers in a course for terry stitches throughout out a prescribed number of courses, and then withdraw the terry sinkers, so that only the main portion of the sinker is utilized in forming non-terry stitches throughout other courses in the garment. Therefore, if one wanted to form terry loops in complete courses throughout a prescribed number of courses, and then form terry loops only in a selected portion of courses throughout another selected group of courses, this would be possible according to conventional techniques. However, the problem occurs when, as in the type of sock described, the operator wants to form terry loops in a first prescribed diametrical area of certain courses, and then provide terry loops in a second diametrical area of other courses, as in the sock described above. There is no conventional technique available for accomplishing this type of construction on simple single feed, single drum circular knitting machines.

Therefore, in the present invention, in addition to the conventional terry loop forming technique for forming terry loops in the sole portion of the sock, there must also be provided a technique for forming terry loops in the shin or front portion of the sock, while the rear area is free of terry loops.

In the set up according to the present invention, all sinkers in the sinker cap are double throated (terry) sinkers. In the portion of the sinker cap corresponding to the sole of the sock, the sinkers have long butts, and in the opposite side of the sinker cap, the double throated sinkers have short butts. During the formation of the sole portion of the sock, according to conventional techniques, the long butted, double throat sinkers are activated, while the short butt sinkers remain retracted, so that the loops are formed over the sinker edge and not in the upper throat. This is a conventional technique and does not have to be explained further herein.

What is non-conventional, however, is that since the terry in the shin or front portion of the sock is formed by the needles and sinkers on the opposite half of the needle cylinder, the terry sinkers corresponding to these needles cannot be activated by the sinker cap without also activating the long butt sinkers in the first half of the sinker cap corresponding to the rear leg portion. Therefore, according to the present invention, by feed and needle manipulation alone, the needles corresponding to the shin or front area must be lifted to grasp both the terry yarn and the both yarn, while the lifting of the needles for the rear leg area must be limited to the extent that they are not elevated high enough to reach the terry yarn, and only the body yarn is pulled down.

The aforementioned needle manipulation is accomplished by utilizing a special cam upstream of the lifting cam which moves in front of and overrides the action of the auxiliary side cam. The special cam lifts both long and short butt needles to an intermediate level, above the tuck level, where the short butt needles are high enough to grasp the body yarn but not the terry yarn. The lifting cam is partially retracted at this time so that it clears the short butt needles and lifts only the long butt needles to an uppermost level to grasp terry yarn. The short butt needles, meanwhile, pass thereby and remain in the intermediate level. The center cam then lowers both the long butt and the short butt needles forming both yarns into loops which are drawn down over the sinkers, the terry yarn being drawn over the upper throat and the body yarn over the sinker edge.

A special offset feed finger for the terry yarn must be provided which feeds the terry yarn to the long butt needles at a point upstream of and above the point of feeding of the body yarn. In other words the terry yarn must be fed prior to the time that the center cam begins to pull the long butt needles down, otherwise the long butt needles would pass under the terry yarn thus missing them.

As the leg portion is completed, the special cam is deactivated and the conventional auxiliary side cam is again in the path of all needle butts. The lifting cam is again returned to its fully extended position where it engages and lifts all needles to the upper stitch level.

It is therefore an object of the present invention to provide a new and improved athletic sock having a cushioned shin area.

It is another object of the present to provide a method and apparatus for forming the athletic sock on a single drum, single feed, circular knitting machine.

It is yet another object of the present invention to provide a method of forming a circular garment on a single feed, single drum knitting machine which has terry loops in diametrically opposed areas of longitudinal discrete portions.

Other objects and a fuller understanding of the invention will become apparent from reading the following detailed description of a preferred embodiment along with the accompanying drawings in which.

DETAILED DESCRIPTION OF A PREFERRED EMBODIMENT

Figure 1:
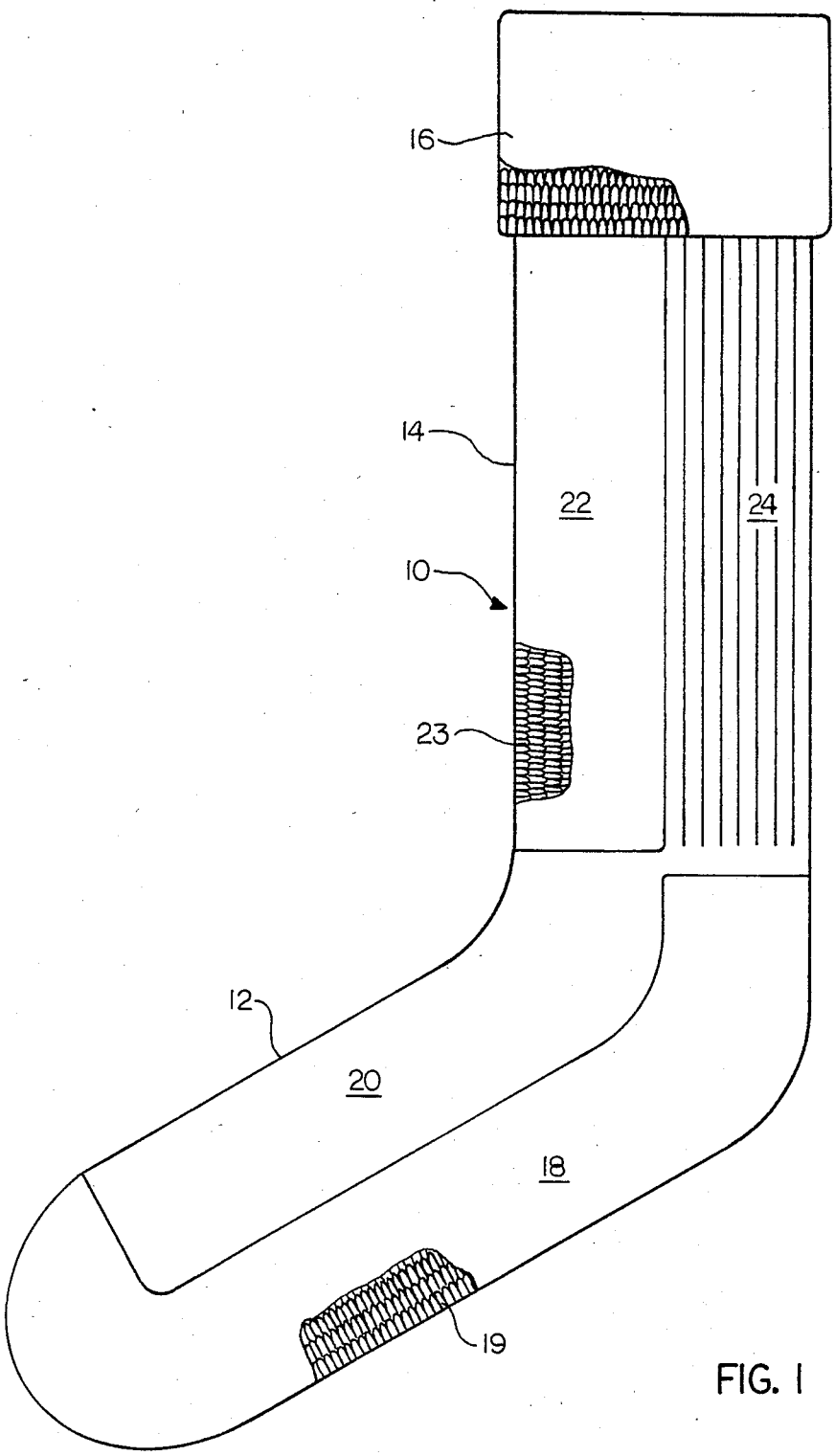
FIG. 1 is a side elevational view of the sock when relaxed in a substantially flattened condition and with portions of the leg and foot broken away to illustrate the terry loops on the inside thereof.

Turning now to the drawings, and particularly to FIG. 1, there is illustrated an athletic sock 10 of the novel construction of the present invention. Sock 10 includes a foot portion 12, a leg portion 14, and an upper cuff portion 16. The foot portion 12 and cuff portion 16 are, in and of themselves, not a novel construction, and are well known in the art. Foot portion 12 includes a cushioned sole area 18 and a plain knit instep portion 20. The cushioned sole area 18 is formed with terry loops 19 on the inside thereof according to well known knitting principles. Also, the cuff portion 16 includes terry loops around the circumference thereof. The novel aspects of the sock appear in the leg portion 14 which includes a front or shin area 22 and a rear area 24.

More particularly, in the shin area 22, there are formed terry loops 23 on the interior surface of the stocking. In a preferred embodiment, the shin area 22 is formed with either a double or triple cushion by using two or three yarns respectively in the terry loops as will be described hereinafter. Also, in the preferred embodiment, the rear area 24 of the leg portion 14 is formed in a conventional mock rib or support construction in which an elastic yarn is interlaced. The support construction and technique for interlacing the elastic yarn is conventional and since its does not form a part of the present invention, does not need to be described further. So constructed, the shin area 22 exhibits an extremely soft and impact resistant characteristic, which will absorb a considerable amount of the impact.

Such a construction as described hereinabove may possibly be formed on certain types of special purpose machines, however, it is further within the scope of the present invention to provide for the construction of such a sock on simple machines, such as, for example, a single feed, single drum circular knitting machine. Such machine includes a head H which carries a throat plate TP into which feed fingers 62,64,66 extend (see FIG. 4A). As described hereinabove, the above preferred construction cannot be accomplished according to conventional techniques. The reason this cannot be done is that conventionally terry loops are formed in a portion of a course by long butt, terry sinkers in a selected portion of the sinker dial. If such sinkers are used to form the terry loops 19 in the sole area 18, then they cannot be deactivated while activating the short butt terry sinkers in the sinker dial as would be necessary to form terry loops 21 in the shin area 22. Therefore, other techniques are necessary.

According to the present invention in its broadest terms, the shin area 22 of the above-described sock is formed by needle manipulation and feeding techniques. In such technique, even though all sinkers in the sinker dial are terry sinkers, and all are in the extended position, only the needles which form the shin area 22 of the leg are lifted to a level to grasp the terry yarn which is being fed through a special feed finger. Meanwhile, the needles which form the rear area 24 are not lifted to such height and only grasp the body yarn for forming the mock rib area.

As earlier mentioned, the needle cylinder and sinker dial of the conventional single feed, single drum circular knitting machine is set up to construct the sock of the present invention. First of all, in the needle cylinder on the semi-circular half of the cylinder which corresponds to the front portion of the sock there are inserted long butt needles. On the other semi-circular half of the needle cylinder which, of course, corresponds to the rear and sole portion of the sock, short butt needles are used. In the sinker dial, however, all sinkers therein are terry sinkers (illustrated in FIG. 2A). In the semi-circular portion of the dial corresponding to the front or shin area 22 of the sock there are utilized short butt terry sinkers 70. On the other hand, in the semi-circular portion of the sinker dial which corresponds to the sole or rear portion of the sock, there are utilized long butt terry sinkers 74. As is apparent to a person of ordinary skill in the art, the long butt sinkers only are engaged during knitting of the foot portion 12 by a retractable cam in the sinker cap. Thus, during each revolution of the sinker cap and dial the long butt sinkers are urged inwardly sufficiently during the forming of the terry loops in the sole portion 18 to place the upper throat of the long butt terry sinkers in the path of the yarn being pulled down to form terry loops in the sole area. On the other hand, during each revolution of the sinker cap and dial since the short butt sinkers are not engaged by the retractable cam, the yarn being fed which would normally form a terry loop is merely pulled down by the needles over the regular sinker edge 80, so that a longer terry loop is not formed in the instep or front area of the foot portion. While on the subject, during the formation of the cuff, the cam which acts on the long butt sinkers may be further extended so that it engages the short butt sinkers also. In such case, terry loops will be formed all the way around the courses of the cuff portion of the sock. The above described formation of terry loops is conventional, and as described hereinabove, if the terry loops in the shin area were on the same side of the sock as the terry loops in the foot portion, there would be no problem.

Figure 2A:
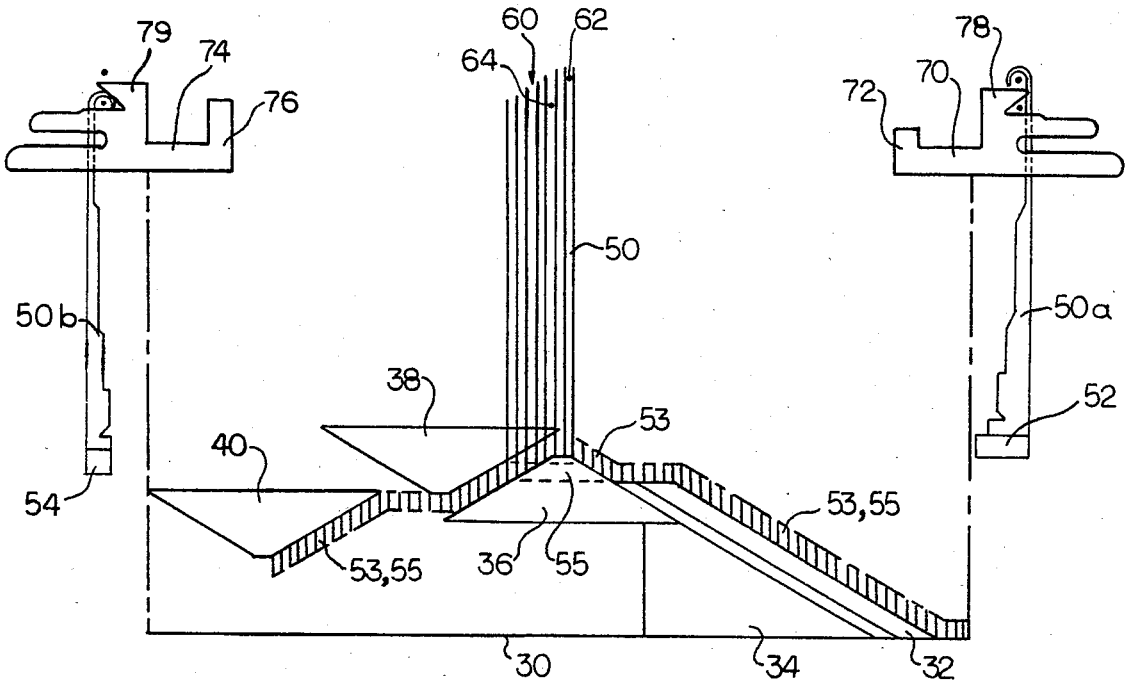
FIGS. 2A and 2B are schematic layouts of the needle operating cams as viewed when looking outwardly from the interior of the needle cylinder of the machine, and respectively showing the relative position of the cams and the path of the needles with respect to the sinkers (side view) during the knitting of the leg portion of the stocking (FIG. 2A) and the foot portion of the stocking (FIG. 2B).
Figure 2B:
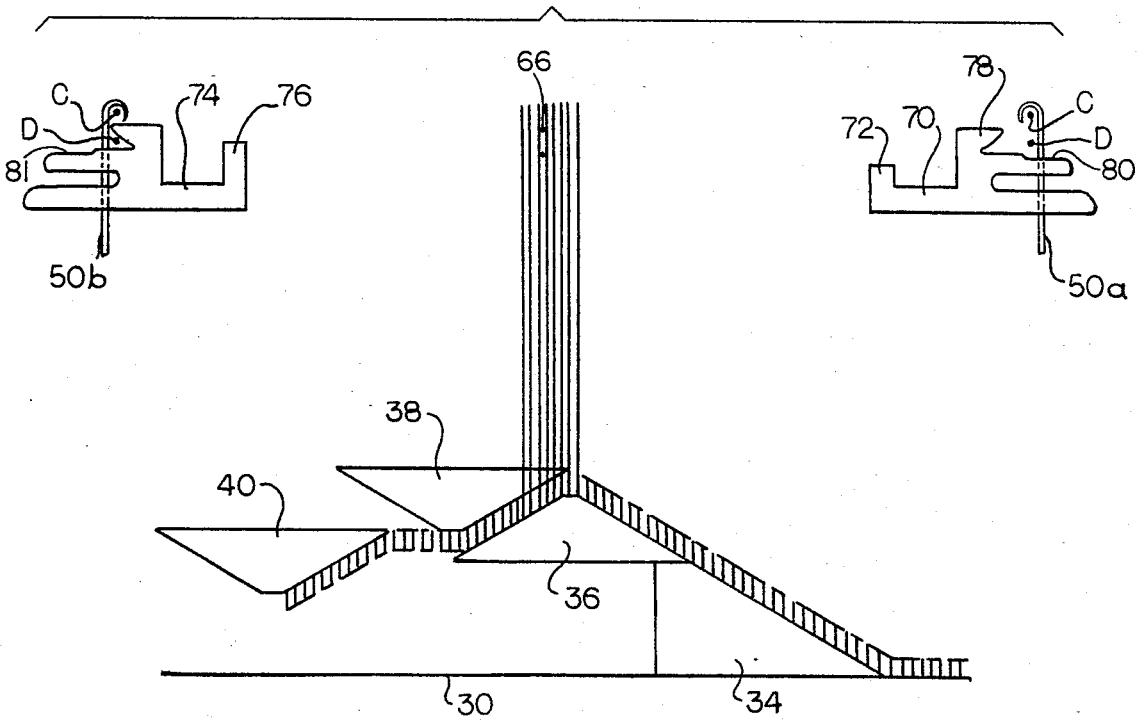

Turning now to FIGS. 2A and 2B of the drawings, there is schematically illustrated a portion of a common type circular knitting machine having a circle of latch needles 50, which are mounted in a slotted needle cylinder, a portion of which is illustrated. Needles 50 are adapted for both rotary and reciprocatory operation past a knitting station. 60. Knitting station 60 is provided with feed fingers 62,64, and 66 (FIGS. 4A and 4B), two of which are shown in FIG. 2A in the formation of the leg area of the stocking.

In the bedplate 30 surrounding the knitting cylinder, there are provided a plurality of cams, some of which are illustrated in FIG. A as cams 32, 34, 36, 38, and 40. Cam 34 is a conventional right hand auxiliary side cam which normally lifts all needles 50 to a position where lifting cam 36 provides the final lifting of the needles into a position that the hooks of the needles are above the yarn being fed at feed station 60. In the present invention, however, there is provided a retractable, special lift cam 32 which, as illustrated in FIG. 2A lifts all needles 50 to an intermediate knitting level higher than that to which the auxiliary side cam 34 normally lifts the needles. As will be described hereafter, during formation of the leg portion the special cam is moved into the path of all needle butts and overrides the normal function of auxiliary side cam 34. There are two types of needles in the present invention, namely, long butt needles **50*a* which have a long butt 52 in the semi-circular portion of the needle cylinder which forms the shin area 22 and short butt needles 50*b* which have a shorter butt 54 in the semi-circular portion of the needle cylinder which forms the rear area 24. Again, in the present invention, during formation of the leg portion 14, the lifting cam 36 is slightly retracted from its normal position adjacent the knitting cylinder so that only the long butt needles 50*a* are engaged the by. As illustrated in FIG. 2A, the long butt needles follow the path 53, while the short butt needles remain at the level illustrated by path 55 passing in behind lifting cam 36. So elevated, the long butt needles 50*a* are lifted to such an elevation that the hooks thereof are above the point at which the terry yarn is being fed by yarn finger 62. Long butt knittings 50*a* will also grasp and pull down the body yarn being fed at yarn finger 64. On the other hand, needles 50*b* remain at the intermediate level to which they are raised by the special cam 32 and grasp only the body yarn being fed at yarn finger 64. Center cam 38 and the left hand stitch cam 40 then cause all needles to lower and resume the conventional path. From this point on the yarn paths 53 and 55 follow the same path until they again return to the succeeding special cam 32 and lift cam 36** where the path is divided. While a single feed operation is shown this could obviously be repeated on a multi feed machine.

Figure 5A:
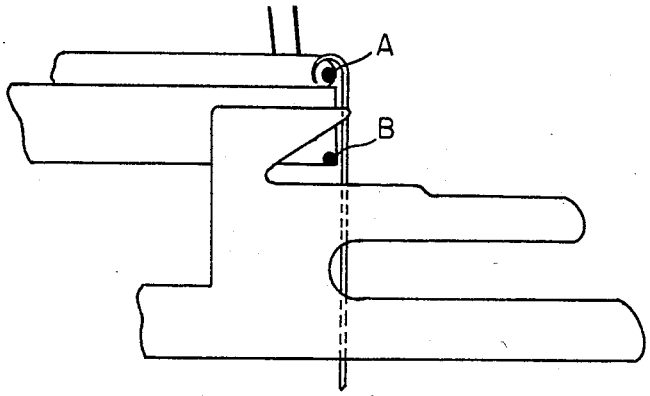
FIGS. 5A and 5B are side views on an enlarged scale schematically illustrating the relative positions of the sinkers and needles at different stages during the formation of a leg portion of the sock.
Figure 5B:
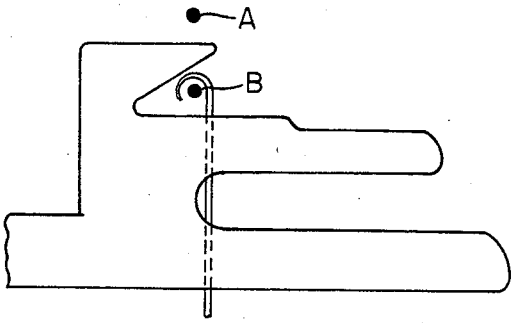
Figure 6A:
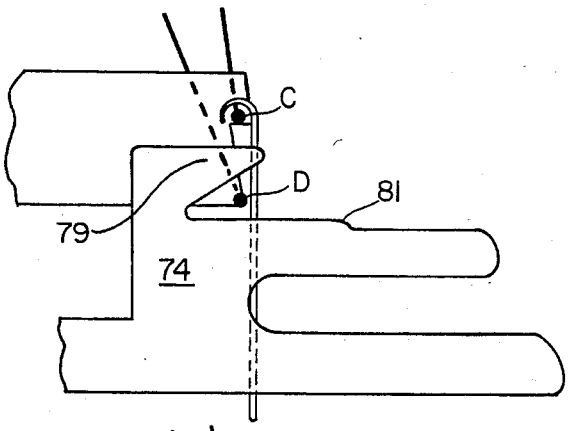
FIGS. 6A and 6B are views on an enlarged scale schematically illustrating the relative positions of the needles and sinkers at different stages during the formation of the foot portion of the stocking.
Figure 6B:
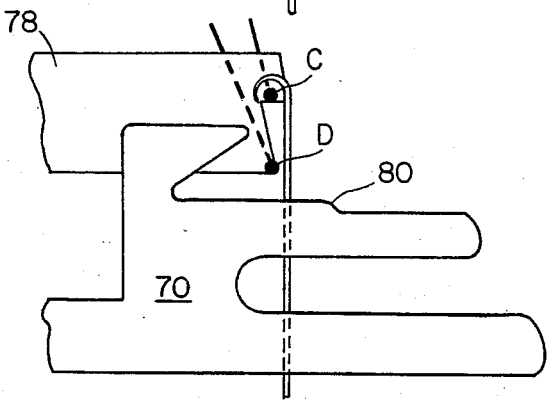

FIG. 2B illustrates the cam arrangement position for the forming of the foot portion of the sock. The set up is generally the same, with the exception that the special cam 32 is retracted so that it no longer engages the butts of any needles (therefore is not illustrated in FIG. 2B). Side cam 34 is now exposed to the oncoming needle butts and acts in its normal capacity to lift all needles to an elevation where they may be engaged by the lifting cam 36. Similarly, the lifting cam 36 has been returned to its normal position where it engages the butts 52,54 of all needles 50. Thus, all needles follow the same path in formation of the foot portion. However, looking at FIGS. 2A, 2B, 5A, 5B, 6A, and 6B, there is illustrated the difference in the sinker position between the relative position between the sinkers and the needles in forming the leg portion (FIGS. 2A, 5A, and 5B) and the relative position between the sinkers and needles in forming the foot portion (FIGS. 2B, 6A, and 6B). As is illustrated in 2B, the sinkers 70 having the short butt 72 remain retracted so that the upper nip 78 over which the terry loops would be formed, is not in the path of the upper yarn. Thus, when the needles **50*a* are urged downwardly by the center cam 38, both yarns D and E will be drawn down over the regular sinker edge 80, thereby missing the upper rib 78. On the other hand, sinkers 74 which have the long butt 76 are in the extended position in FIG. 2B and therefore the yarn C, when pulled down by needles 50*b* will form a loop over the nib 79, and thus, will form terry loops with the body yarn D which is pulled down over the regular sinker edge 81**.

Figure 3A:
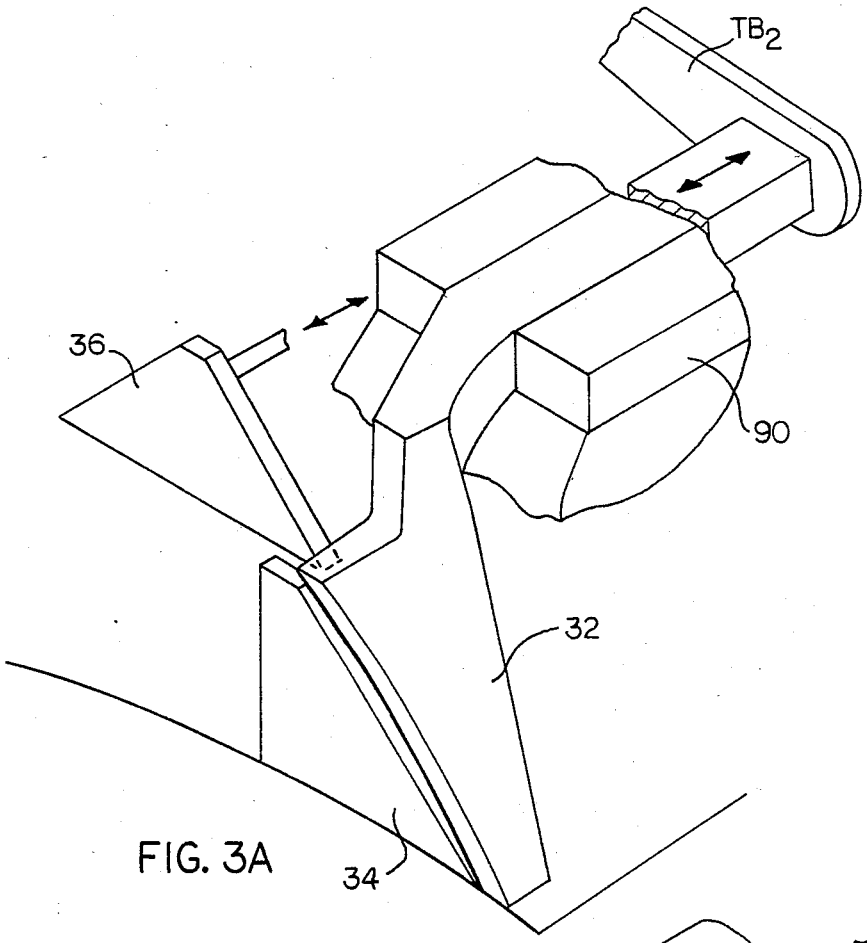
FIGS. 3A and 3B are perspective views illustrating the special cam and its relation to the auxiliary side cam and lifting cam during the knitting of the leg portion (FIG. 3A) and the foot portion (FIG. 3B).
Figure 3B:
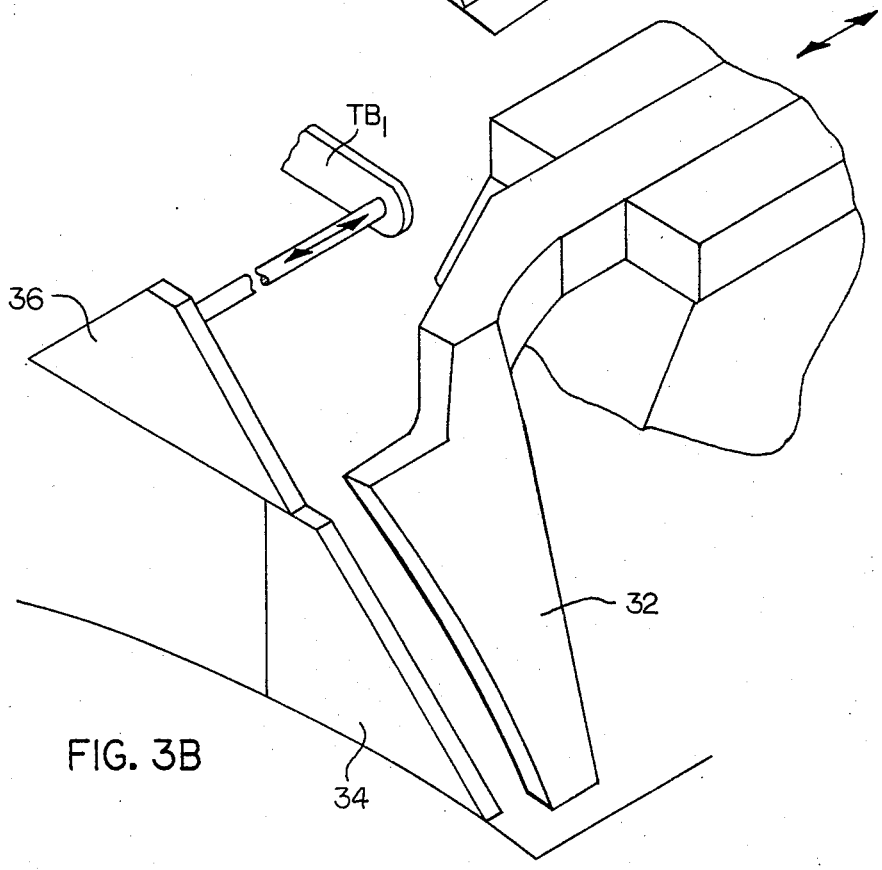

For purposes of illustration, there is shown in FIGS. 3A and 3B an isometric view of the arrangement of the portion of bed plate 30 which includes special cam 32 and the lifting cam 6. As is illustrated in FIG. 3A, during formation of the leg portion of the sock, the special cam 32 which is slidably mounted in a slide block 90 is extended so that it engages the butts of all needles 50. On the other hand, during the formation of the other portions of the sock, the special cam 32 is retracted by conventional equipment (such as a thrust block $TB_2$ operated in a main drum), so that it is out of the path of the butts of all needles 50. The lifting cam 36 is slightly retracted to a second position in FIB. 3B, by conventional equipment (such as a thrust block $TB_1$ operated from the main drum) so that it engages the butts 52 of the long butt needles **50*a*, but allows the butts 54 of the short butt needles 50*b* to pass thereunder without effecting any further lifting action thereto. So arranged, the special cam 32 and lifting cam 36 act as a means for dividing the long butt needles 50*a* and the short butt needles 50*b* into separate feed paths to the needles, so that the long butt needles 50*a* form the cushioned front portion of the stocking, and the short butt needles 50*b*** form the rear area of the leg portion by grasping only the body yarn. It should be pointed out here, that the ribbed construction which forms the support for the leg is formed in a conventional manner by interlacing an elastic yarn in a mock rib construction whereby the elastic interlaced in one wale, then floated across the two succeeding wales. This is a conventional $2\times1$ rib knitting technique and does not need to be further illustrated or described here.

Figure 4A:
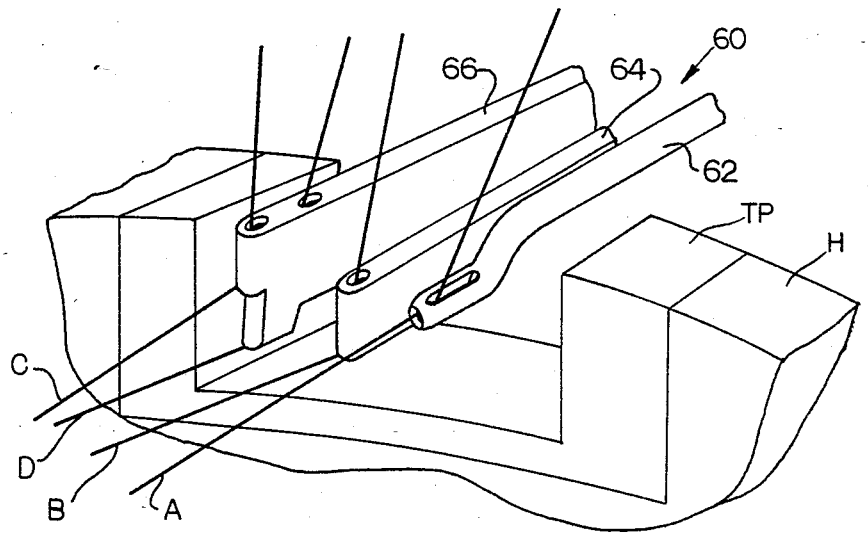
FIG. 4A is a perspective view, with parts broken away, looking from the interior of the knitting cylinder toward the yarn feed station.
Figure 4B:
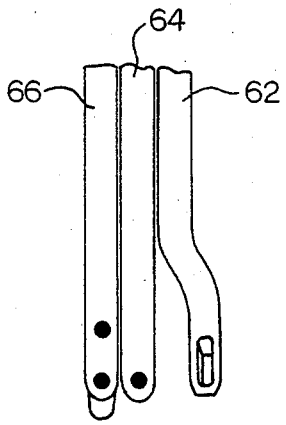
FIG. 4B is a diagramatic plan view of the yarn figures in FIG. 4A.

Turning now to FIGS. 4A and 4B, there is illustrated the yarn feed station 60 which includes three yarn feed fingers 62,64, and 66 extending through throat plate TP in the head H of the single drum, circular machine. Yarn fingers 62 and 64 are utilized to feed yarns A and B to the proper position for forming the leg portion of the sock. The yarn(s) is fed through yarn finger 62 and is introduced to the needle cylinder at a point above the body yarn B which is fed through the conventional yarn finger 64. During the forming of the leg, the yarn finger 66 is retracted or raised by conventional equipment, so that neither yarns C or D is in the path of the needles. In addition to being at an elevation higher than yarn B, yarn A must also be introduced considerably upstream of the point where yarn B is introduced. The reason for this is that (referring to FIG. 2A) the needles **50*a* begin to be lowered at a point prior to the lowering of needles 50*b*. Therefore, yarn A must be introduced to the hooks of needles 50*a* prior to the time those needles are taken down by the center cam 38. Therefore, an offset finger 62 (see FIG. 4B**) is utilized.

During the formation of the foot portion, the yarn fingers 62 and 64 are both retracted or raised, and the conventional terry yarn feed finger 66 is lowered into position. Yarns C and D are then introduced conventionally as illustrated in FIGS. 6A and 6B. In this regard, the short butt sinkers 70 remain retracted. Even though the yarns C and D being fed through yarn finger 66 are always in a position for forming terry loops, during the formation of the instep 20 as the needles 50 are brought down, the yarn C misses the upper nib 78 of sinkers 70. Thus, the upper yarn C is merely pulled down over the edge 80 of sinker 70 along with lower yarn D and a double loop is formed, however, both loops are the same size. The long butt sinkers 74 however, in the foot portion, are extended so that during formation of the sole area 18, the needles 50 grasp and pull the yarns C and D down. Since the sinkers are extended, yarn C is caught by the nib 79, and a terry loop is thus formed.

In operation, then, during the formation of the cuff portion 16 all sinkers 70, 74 are extended to their innermost position, and all needles 50*a*, 50*b* are elevated together with the cam arrangement as illustrated in FIG. 2B. Thus, during this time terry loops are formed in all wales in all courses.

/When the knitting proceeds to the leg portion, again all sinkers are extended to their innermost position; however, the cams are arranged as illustrated in FIG. 2A. Therefore, as the knitting proceeds, the long butt needles 50*a* will be elevated to such a position that they grasp the yarn(s) A and pull that yarn down with yarn B thereby forming terry loops over the nib 78 of the short butt sinkers 70 in the shin area 22. At the same time, even though the long butt sinkers 74 are also extended to their innermost position, the short butt needles, which form the rear area 24, are not lifted high enough to grasp the upper yarn(s). The result is that only the body yarn is grasped by the hook of the short butt needles and no terry loops are formed.

As the knitting proceeds to the foot portion, the sinker cap cams are so arranged that only the long butt sinkers 74 are extended to their innermost (terry) position, with the short butt sinkers 70 being retained slightly retracted (non-terry) as illustrated in FIG. 2*b*. The needle cam arrangement is at the same time as illustrated in FIG. 2B, so that all needles are lifted to the same point. As the knitting proceeds in this portion of the sock, the needles 50*b* pull yarn C over the nib 79 of long butt sinkers 74 and grasp the body yarn D pulling it down over the conventional edge 81 of sinker 74, thus forming terry loops in the sole portion of the sock. Simultaneously, needles 50*a* grasp both yarns C and D, however, since the sinkers 70 are slightly retracted, the yarn C misses the nib 78 and both yarns C and D are pulled down across the edge 80 of sinker 70 to form non-terry stitches.

It should be recognized that although there is only illustrated one yarn A utilized in the terry loop in cushion area 22 of the leg portion 14, it is a simple matter to simultaneously introduce two yarns through the yarn finger 62 so that a double terry loop is formed. This is what is meant in preferred embodiment by a "double cushion." Also, three yarns could be introduced to form a "triple cushion." While a preferred embodiment has been described and illustrated hereinabove, it is apparent that various changes and modifications might be made without departing from the scope of the invention which is set forth in the claims below.

What is claimed is:

1. Method of knitting a cushioned shin (front) area in the leg portion of a seamless athletic sock on a circular, single drum machine, which sock also has a cushioned sole formed on the underside (rear) of the foot portion, said method comprising the steps of:

(a) providing long butt needles in one semi-circular half of the needle cylinder that corresponds to the front area of the sock and short butt needles on the other semi-circular half of the needle cylinder that corresponds to the rear area of the sock;

(b) feeding in a body yarn at a first lower feed position and at least one terry yarn at a second terry feed position above said first position;

(c) in advance of the yarn feed stations lifting the long butt needles alone to an elevation corresponding to the aforesaid second terry feed position while maintaining the short butt needles at an elevation corresponding to said first position and below said second position;

(d) with said long butt needles pulling said terry yarn down over the upper nibs of terry sinkers while simultaneously pulling said body yarn over the main loop forming edge of said terry sinkers to form said cushioned shin area; and (e) said short butt needles pulling said body yarn alone down over said sinkers to form said rear area which is void of terry loops.

2. The method according to claim 1 and further forming, in the foot portion of said sock, a cushioned sole portion using said short butt needles alone with terry sinkers, wherein said short butt needles are fully lifted to an elevation sufficient to grasp both a terry yarn and a body yarn.

3. The method according to claim 1 wherein during the forming of said leg portion, said short butt needles form said body yarn into support ribs.

4. Apparatus for knitting a cushioned shin (front) area in the leg portion of a seamless athletic sock on a circular machine, which sock also has a cushioned sole formed on the underside (rear) of the foot portion, said apparatus comprising:

(a) long butt needles in one semi-circular half of the needle cylinder that corresponds to the front area of the sock and short butt needles in the other semi-circular half of the needle cylinder that corresponds to the rear area of the sock;

(b) feed means for feeding in a body yarn at a first lower feed position and at least one terry yarn at a second terry feed position above said first position;

(c) a retractable special cam positioned in advance of said yarn feed means and having a first position in the path of all needles for lifting all needles to an intermediate level aligned with said first lower feed position and a second position out of the path of all needles;

(d) a retractable lifting cam positioned downstream of said special cam and having a first retracted position in the path of said long butt needles for lifting said long butt needles to an elevation corresponding to the aforesaid second terry feed position while allowing the short butt needles to pass therebehind and be maintained at said intermediate level below said second position, said lifting cam having a second extended position in the path of all needles;

(e) said special cam and said lifting cam in said first position during the knitting of said leg portion, then returning said cams to said second position during the knitting of the remainder of said sock;

(f) whereby said long butt needles pull said terry yarn down over the upper nibs of terry sinkers while simultaneously pulling said body yarn over the main loop forming edge of said terry sinkers to form said cushioned shin area; and (g) whereby said short butt needles pull said body yarn alone down over said sinkers to form said rear area which is void of terry loops.

5. The apparatus according to claim 4 wherein said feed means of paragraph (b) comprises separate feed fingers, one for said body yarn and one for said terry yarn, said terry yarn feed finger being spaced upstream from said body yarn feed finger.

* * * * *